United States Patent [19]

Goncalves

[11] Patent Number: 4,901,891

[45] Date of Patent: Feb. 20, 1990

[54] END FITTING FOR DISPENSING A FOAMING PRODUCT

[75] Inventor: Antonin Goncalves, Groslay, France

[73] Assignee: L'Oreal, Paris, France

[21] Appl. No.: 38,747

[22] Filed: Apr. 15, 1987

[30] Foreign Application Priority Data

Apr. 30, 1986 [FR] France ..... 86 06273

[51] Int. Cl.[4] ..... B65D 83/14

[52] U.S. Cl. ..... 222/402.13; 222/108; 222/402.21

[58] Field of Search ..... 222/108, 189, 402.21, 222/402.13, 402.12, 402.23, 402.15; 239/110, 111, 119, 120, 424.5, 371

[56] References Cited

U.S. PATENT DOCUMENTS

| | | | |
|---|---|---|---|
| 2,981,446 | 4/1961 | Campbell | 222/402.13 |
| 3,377,005 | 4/1968 | Marder | 222/402.13 |
| 3,406,878 | 10/1968 | Kotuby | 222/402.1 |
| 3,434,633 | 3/1969 | Green | 222/402.13 |
| 3,785,528 | 1/1974 | Mandeltort | 222/402.13 X |
| 3,888,392 | 6/1975 | Van Coney | 222/108 |
| 4,034,427 | 7/1977 | Breznock et al. | 222/402.13 X |

FOREIGN PATENT DOCUMENTS

| | | |
|---|---|---|
| 1099584 | 9/1955 | France . |
| 2086738 | 12/1971 | France . |
| 2453794 | 11/1980 | France . |
| 2476034 | 8/1981 | France . |

*Primary Examiner*—Joseph J. Rolla
*Assistant Examiner*—Boris Milef
*Attorney, Agent, or Firm*—Cushman, Darby & Cushman

[57] ABSTRACT

An end fitting for dispensing a foaming product in a pressurized container fitted with an emergent valve stem comprises a fixing element holding it on the container and a movable dispensing element. This dispensing element comprises an internal bore and a dispensing tube. In the lower wall of the bore is at least one groove whose top is disposed between the upper and lower levels occupied by the emergent stem, and whose bottom issues above the valve cup.

10 Claims, 2 Drawing Sheets

END FITTING FOR DISPENSING A FOAMING PRODUCT

FIELD OF THE INVENTION

The present invention concerns an end fitting for dispensing a foaming product intended to be fitted on a pressurized container provided with a valve with an emergent stem.

PRIOR ART

Such an end fitting generally comprises a fixing element to hold it on the container, and a dispensing element which is movable in relation to this fixing element. The dispensing element comprises, on the one hand, an internal bore intended to receive the emergent stem of the valve in a leakproof manner and, on the other hand, a dispensing tube whose internal duct communicates with the bore. The top of the emergent stem occupies in this bore a first level called the lower level when the dispensing element is not subjected to any action on the user's part, and a second level called the upper level, when the user acts on the dispensing element to dispense the product contained in the pressurised container.

Thus when the user exerts pressure on the dispensing element, he produces, on the one hand, the opening of the valve fitted on the container, and hence effects ejection of product from this container into the tube and, on the other hand, he lowers the bottom portion of the tube around the valve stem thanks to the bore. The foaming product is then ejected into the tube and delivered to the upper portion of the tube where the user can take up the quantity of the foaming product delivered. When the user relaxes his pressure on the dispensing element, he causes the valve to close, stopping the ejection of foaming product into the tube and its arrival at the upper end of the tube. Moreover, the small quantity of the foaming product which is still inside the tube, that is to say, in the internal duct thereof, remains there. After a certain time, the foaming product remaining in the tube will have a tendency to liquefy in such a way that it will flow along the tube wall as far as the emergent stem of the valve. The liquefied foam can thus penetrate into this stem where it will dry out, blocking the tube and preventing the valve from operating when the user next presses on the dispensing element.

OBJECT OF THE INVENTION

It is a principal object of the present invention to provide an end fitting of the type described above which eliminates this drawback whilst being straightforward and economical.

SUMMARY OF THE INVENTION

This object, as well as others, which will become apparent below, are attained by means of an end fitting for dispensing a foaming product of the above-mentioned type which is characterised in that in the lower wall of the bore, there is arranged at least one groove whose top is disposed between the above-mentioned upper and lower levels and whose base opens out above the valve cup in a zone of the bore which is not closed by the valve stem.

Preferably, the zone of the bore into which the bottom of the or each groove opens has a flaring shape whose large cross-section is the one nearest to the valve cup and whose small cross-section is connected to a zone of the bore whose cross-section is substantially that of the emergent stem, this latter zone containing the top of the or each groove. This flaring zone of the bore is, for instance, frusto-conical.

Advantageously, the zone of the bore whose cross-section is substantially that of the emergent stem, is a cylindrical zone with a circular cross-section, the top of the emergent stem abutting, at its upper level, an annular shoulder in the central zone whence the internal duct of the dispensing tube emerges.

Preferably, the end fitting comprises a plurality of grooves. The or each groove is substantially parallel to the axis of the bore.

Advantageously, the bore of each groove has a rectangular cross-section, in the zone of the bore whose cross-section is substantially that of the emergent stem.

When the end fitting comprises several grooves, they are preferably regularly distributed in the wall of the bore.

In a preferred embodiment of the invention, the element fixing the end fitting to the container is a collar which is catch-engaged on the crimped bead of the valve cup. In that case, the dispensing element comprises a small disc fixed to the collar by an elastic hinge, this disc being provided with a pusher element and carrying the dispensing tube which is disposed substantially perpendicular to the disc.

BRIEF DESCRIPTION OF THE DRAWINGS

The description which follows, which is not of a restrictive nature, should be read in conjunction with the attached drawings wherein.

DESCRIPTION OF THE PREFERRED EMBODIMENT

Figure 1:
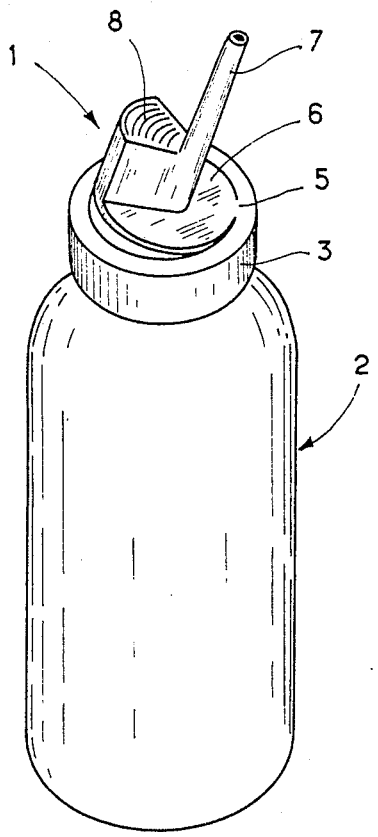
FIG. 1 is a perspective view of a pressurised container comprising an end fitting in accordance with the present invention.
Figure 2:
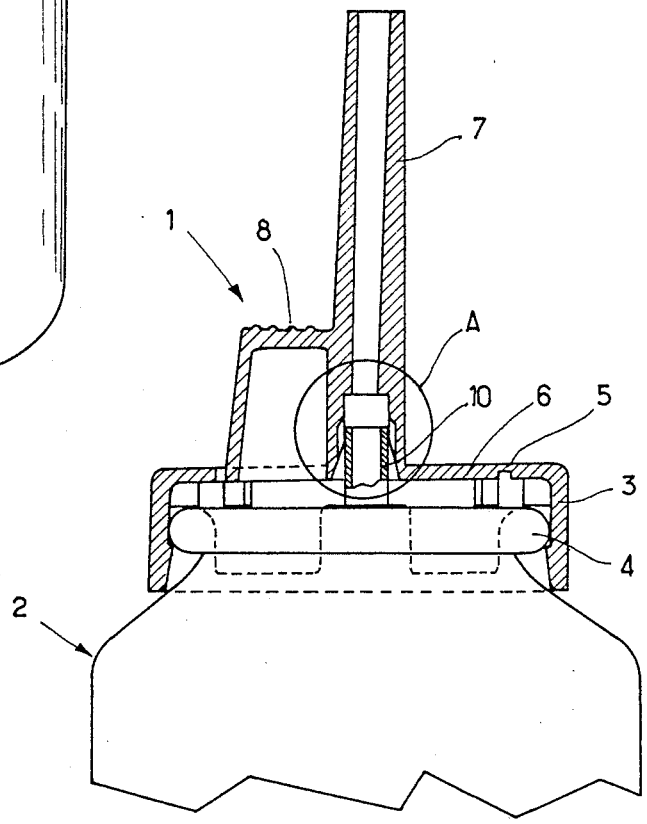
FIG. 2 is a vertical cross-section of the upper portion of the pressurised container of FIG. 1 comprising this end fitting.

As may be seen in FIGS. 1 and 2 in particular, an end fitting generally designated 1, for dispensing a foaming product contained in a pressurised container 2, comprises as the fixing element a collar 3 to be fixed by catch-engagement on the crimped bead of the valve cup 4. It also comprises a dispensing element which comprises a disc 6 fixed to the collar 3 by an elastic hinge 5. This elastic hinge 5 is relatively thick so as to have a restoring faculty allowing the disc 6 to return into a substantially horizontal position after use. This disc 6 is provided with a pusher element or push button 8 and carries a dispensing tube 7 which is in the present embodiment substantially perpendicular to the disc 6.

Figure 3:
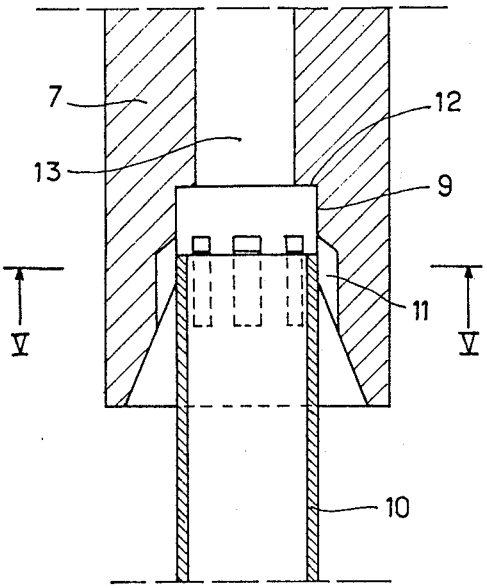
FIG. 3 is a sectional view on an enlarged scale of detail A of FIG. 2 when no force is being exerted on the valve of the pressurised container.

As may, in particular, be seen in FIG. 3, this tube comprises in its lower portion, that is to say, the portion which is joined to the disc 6, an internal bore 9 to receive, in a leakproof manner, the emergent stem 10 of the valve of the pressurised container 2. As shown in FIG. 3 when the user does not exert any action on the push button 8 the top of the emergent stem 10 of the valve occupies a first level in the bore 9, termed the lower level. It occupies a second level, termed the upper one, when the user exerts a force on this push button 8 to dispense a quantity of the product.

In accordance with the present invention there is arranged, in the lower wall of the bore 9, at least one groove 11, in this case several whose tops are disposed between the lower and upper levels and whose bottoms issue above the valve cup 4 in a zone of the bore 9 which is not closed by the emergent stem 10 of the valve. These grooves 11, which in this embodiment are eight in number, are regularly distributed in the wall of the bore 9 and are substantially parallel to its axis.

The zone of the bore 9 where the bottom of the grooves 11 issues, has a flaring frusto-conical shape whose larger cross-section is the one nearer to the valve cup 4 and whose smaller cross-section is the one joined to a zone of the bore 9 whose cross-section is substantially that of the mergent stem, save for the clearance necessary to allow this stem to slide in the bore 9. The grooves 11 have their tops situated in this latter zone and have a rectangular transverse cross-section. This same zone is cylindrical with a circular cross-section, the top of the emergent stem sealingly bearing at its upper level on an annular shoulder 12 in the central zone where the internal duct 13 of the dispensing tube 7 emerges.

Figure 4:
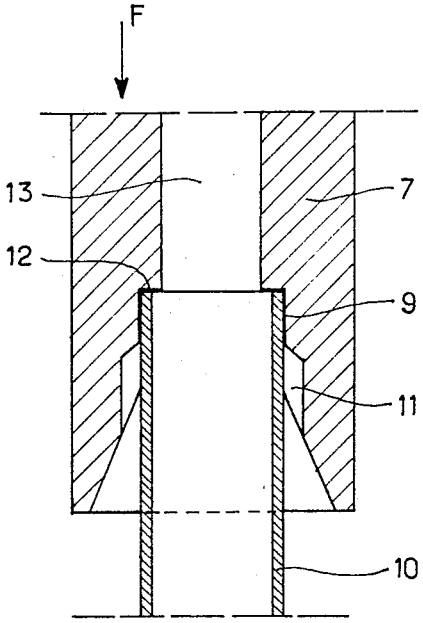
FIG. 4 corresponds to FIG. 3 when a force is exerted on the valve of the pressurised container.
Figure 5:
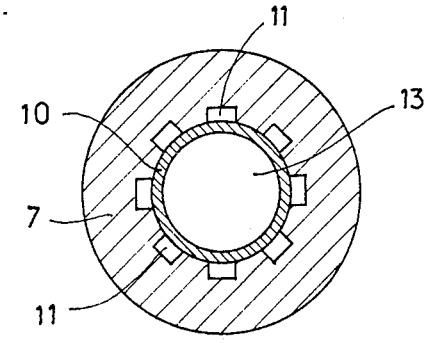
FIG. 5 is a transverse cross-section taken along line V—V of FIG. 3.

When the user exerts pressure on the push button 8, as shown by the arrow F in FIG. 4, he lowers the disc 6 by rotation around the hinge 5 in such a way that the valve is caused to open. Some foaming product is then ejected from the container 2 into the tube 7. The user takes up some foaming product at the end of the tube 7 while maintaining his pressure on the push button 8. Because of the lowering of the disc 6, the shoulder 12 sealingly abuts the top of the emergent stem 10 which thus closes off the top of the grooves 11.

When the user relaxes his action on the push button 8, the valve closes, and the disc 6 and hence the tube 7 rise again along the stem 10. In this position, shown in FIG. 3, the top of the emergent valve stem is situated below the top of the grooves 11. Thus the walls of the emergent valve stem 10 and of the tube 7 delimit, at the level of the grooves 11, passages through which, as explained above, the foaming product contained in the tube 7 which will have liquefied after the ejection of a quantity of foam can be discharged.

The liquefied foaming product evacuated through the grooves 11 is received in the valve cup 4 and thus does not stagnate above the upper end of the valve stem 10 in the vicinity of the bore 9; it will therefore no longer have the tendency to penetrate inside the valve stem 10 and hence to block it by drying out.

I claim:

1. In an end fitting for dispensing a foaming product contained in a pressurized container fitted with an emergent stem carried by a valve cup having a crimped bead, the said end fitting comprising:

(a) fixing means for holding the end fitting on the container;

(b) dispensing means movable relative to said fixing means, said dispensing means defining firstly an internal bore arranged in slidably contacting relationship with said emergent stem of the valve to sealingly receive said stem and secondly a dispensing tube whose internal duct communicates with said bore, the top of said emergent stem of the valve occupying in the bore a first level, termed the lower one, when the dispensing means in not subjected to any force by the user and a second level, termed the upper one, when a user acts on the dispensing means to produce the dispensing, the improvement wherein the lower wall of the said bore has a portion defining at least one groove the top of which is disposed between said upper and lower levels and the bottom of which opens above the valve cup in a zone of the bore which is not closely by the emergent stem of the valve; said emergent stem having a longitudinal axis and said at least one groove extending generally parallel to said longitudinal axis and being movable with said dispensing means between a first position, corresponding to when a user acts on the dispensing means to produce the dispensing, and wherein flow through said at least one groove is blocked by said emergent stem and a second position, corresponding to release of said dispensing means, wherein flow through said at least one groove is permitted.

2. An end fitting according to claim 1, wherein the zone of the bore where the bottom of the or each channel issues has a flaring shape whose larger cross-section is joined to a zone of the bore whose cross-section is substantially that of the emergent stem, this latter zone containing the top of the at least one groove.

3. An end fitting according to claim 2, wherein said flaring zone of the bore is frusto-conical

4. An end fitting according to claim 2, wherein the zone of the bore whose cross-section is substantially that of the emergent stem, is a cylindrical zone with a circular cross-section, and wherein the upper level of the top of the emergent stem abuts an annular shoulder in the central zone of which the internal duct of the dispensing tube issues.

5. An end fitting according to claim 2, wherein said at least one groove has a rectangular cross-section in the zone of the bore whose cross-section is substantially that of the emergent stem.

6. An end fitting according to claim 1, comprising a plurality of said grooves.

7. An end fitting according to claim 6, wherein said grooves are regularly distributed in the portion of the bore.

8. An end fitting according to claim 1, wherein said at least one groove is substantially parallel to the axis of the bore.

9. An end fitting according to claim 1, wherein said fixing means is a collar able to be catch-engaged on the crimped bead of the valve cup.

10. An end fitting according to claim 9, wherein said dispensing means comprises a disc fixed to the collar by an elastic hinge, said disc being provided with a pusher element and carrying said dispensing tube, said dispensing tube being disposed substantially perpendicular to the disc.

* * * * *